United States Patent [19]

Malek et al.

[11] 4,203,251

[45] May 20, 1980

[54] TOY BALL WITH GEAR-DRIVEN FIGURE

[75] Inventors: Jack H. Malek, Westbury, N.Y.; Herman M. Siegel, Stamford, Conn.

[73] Assignee: CBS Inc., New York, N.Y.

[21] Appl. No.: 904,041

[22] Filed: May 8, 1978

[51] Int. Cl.[2] ..... A63H 15/00

[52] U.S. Cl. ..... 46/107; 46/204; 185/27; 185/30

[58] Field of Search ..... 46/1 R, 97, 98, 99, 46/100, 106, 107, 204, 205, 206, 207, 208; 185/27, 30, 31

[56] References Cited

U.S. PATENT DOCUMENTS

| | | | |
|---|---|---|---|
| 955,435 | 4/1910 | Reed | 46/1 R |
| 2,519,248 | 8/1950 | Hulbert | 46/100 |
| 2,949,697 | 8/1960 | Licitis et al. | 46/207 |
| 3,058,261 | 10/1962 | Lakin | 46/99 |
| 3,798,835 | 3/1974 | McKeehan | 46/100 X |

FOREIGN PATENT DOCUMENTS

| | | | |
|---|---|---|---|
| 443666 | 5/1927 | Fed. Rep. of Germany | 46/205 |

*Primary Examiner*—F. Barry Shay

*Attorney, Agent, or Firm*—Seidel, Gonda, Goldhammer & Panitch

[57] ABSTRACT

A rigid, hollow transparent ball has a figure therewithin. As the ball rotates, the figure is rotated by the mesh between a gear fixed to the figure and a gear fixed to the inner surface of the ball.

8 Claims, 5 Drawing Figures

FIG. 2
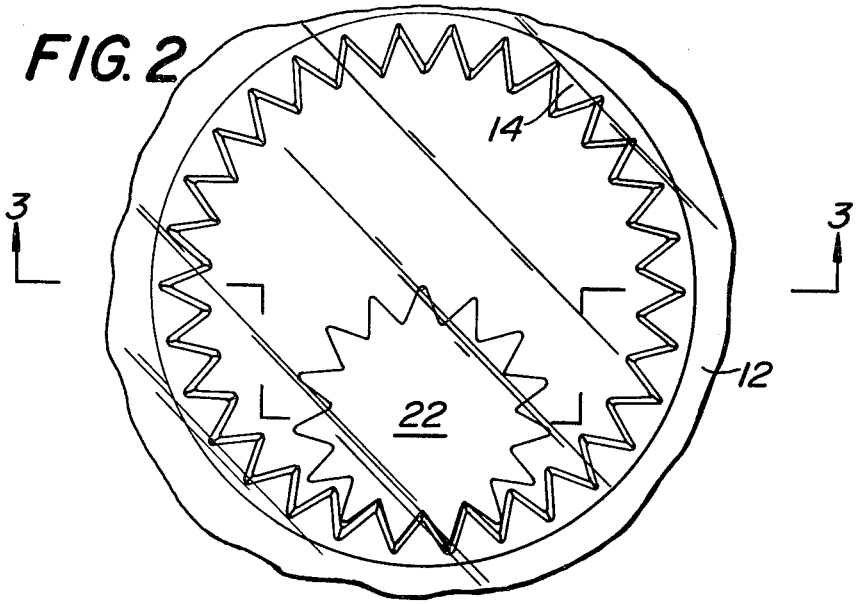
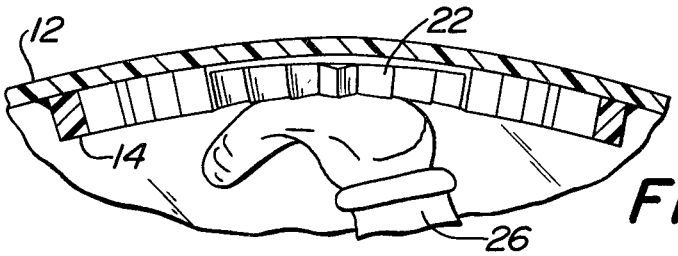
FIG. 3
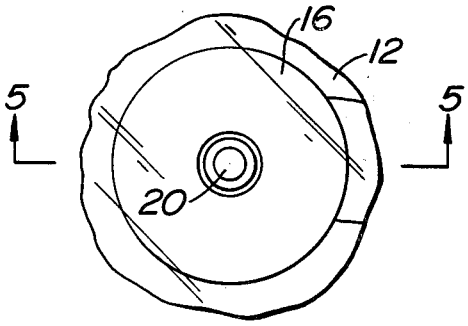
FIG. 4
FIG. 5
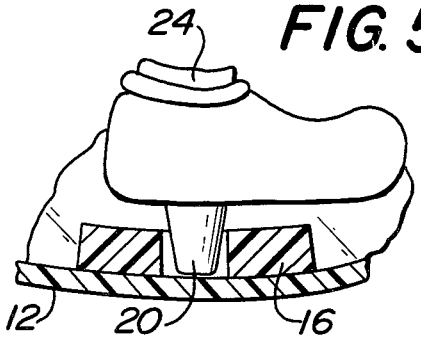

TOY BALL WITH GEAR-DRIVEN FIGURE

BACKGROUND

Rigid hollow transparent balls having a figure therewithin are known. See U.S. Pat. No. 3,058,261 wherein a free-floating figure is disposed within the ball. A ball that has a figure which moves due to the rotation of the ball is an attraction to children. Due to the free-floating nature of the figure in the ball disclosed in said patent, frequently the figure does not move when the ball is rolling. The present invention addresses itself to the problem of providing a positive means to assure that the figure will move when the ball is rotated.

SUMMARY OF THE INVENTION

The toy ball of the present invention is a rigid, hollow transparent ball having a figure therein. A first gear is fixed to the inner periphery of the ball. A second gear is fixed to the figure. The gears are in mesh so that rotation of the ball will rotate the figure.

It is an object of the present invention to provide a novel toy ball which is transparent and has a figure therewithin which is moved when the ball is rotated.

Other objects will appear hereinafter.

For the purpose of illustrating the invention, there is shown in the drawings a form which is presently preferred; it being understood, however, that this invention is not limited to the precise arrangements and instrumentalities shown.

FIG. 2 is a plan view of one portion of the ball on an enlarged scale.

FIG. 3 is a sectional view taken along the line 3—3 in FIG. 2.

FIG. 4 is a plan view of another portion of the ball on an enlarged scale.

FIG. 5 is a sectional view taken along the line 5—5 in FIG. 4.

Referring to the drawings in detail, wherein like numerals indicate like elements, there is shown a toy ball in accordance with the present invention designated generally as 10.

Figure 1:
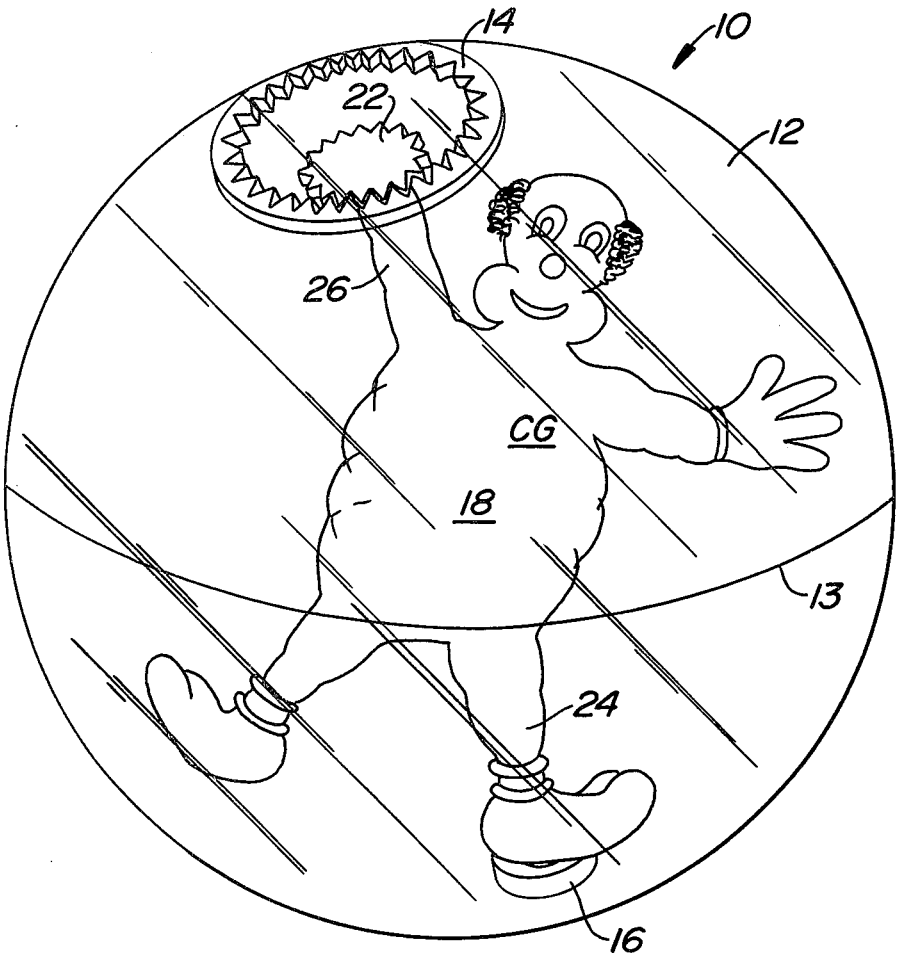
FIG. 1 is a perspective view of the ball of the present invention.

The toy ball 10 includes a rigid, hollow transparent sphere 12. The sphere 12 may conveniently be formed as hemispheres which are then joined together along the seam 13 in any convenient manner such as by use of adhesives. The sphere 12 may be made from any one of a wide variety of polymeric plastics which are transparent and rigid.

As shown in FIGS. 1, 2 and 3, a first gear 14 is fixedly secured to the inner periphery of the sphere 12 by use of adhesives, ultrasonic welding or the like. Gear 14 is preferably made from the same material as sphere 12 so as to also be transparent. If desired, gear 14 may be opaque. Gear 14 is preferably an annular gear with teeth on its inner periphery.

At a location which is generally diametrically opposite the gear 14, there is provided an annular bearing 16 on the inner periphery of the sphere 12. See FIGS. 1, 4 and 5. Bearing 16 is preferably made from the same material as sphere 12 so as to be transparent. If desired, bearing 16 may be opaque. Bearing 16 is fixedly secured to the inner surface of the sphere 12 in any convenient manner such as by adhesives, ultrasonic welding and the like.

A figure 18 is rotatably supported within the sphere 12. The figure 18 may be solid or hollow and is preferably made from a polymeric plastic so that it may be injection molded into a wide variety of forms such as a clown, a bird, a person, a popular cartoon personality, an animal, or any other recognizable object or thing.

The figure 18 is associated with the bearing 16 and the gear 14 in a manner so that the figure will be rotated and will otherwise move as the sphere 12 is rolled and/or tumbled. The portion of figure 18 associated with the bearing 16 is conveniently attained by providing a tapered extension portion 20 on the leg 24. The portion 20 extends into the bearing 16. The hole in the bearing 16 is provided with transverse dimensions greater than the transverse dimensions of the portion 20 so that the figure 18 may tilt to a limited degree as well as rotate. A suitable taper for portion 20 is 20° to 25° when the sphere 12 has a diameter of 8 to 10 inches.

The figure 18 is conveniently associated with the gear 14 by means of arm 26 which terminates in a gear 22. The gear 22 is in mesh with the gear 14. When gear 14 is an annular gear having teeth on its inner periphery, gear 22 has teeth on its outer periphery. As shown in the drawings, the pitch diameter of gear 22 is approximately ½ the pitch diameter of gear 14. As shown more clearly in FIG. 3, gear 22 has a side face remote from arm 26 which is juxtaposed to and spaced from the inner surface of the sphere 12 within the gear 14. Thus, the dimensions of the figure 18 including the distance from projection 20 to the gear 22 is such that the figure cannot escape from either the bearing 16 or the gear 14.

As the sphere 12 is rotated, the gear 22 is rotatably driven by the sphere 14 to cause the figure 18 to rotate. Gear 22 is free to move diametrically across the gear 14 whereby the figure 18 pivots. Such pivotable movement of the figure 18 is accomodated by the tapered portion 20 and the size of the hole in bearing 16. The figure 18 has sufficient mass and an eccentrically located center of gravity CG so as to enable the figure to cause its gear 22 to seek the lowest point on the gear 14 when the sphere 12 is stationary.

It is within the scope of the present invention to reverse the gears 22 and 14. That is, the gear attached to the figure 18 may be an annular gear with teeth on its inner periphery with the gear attached to the sphere 12 being provided with teeth on its outer periphery. Also, it is within the scope of the invention to reverse the relationship between projection 20 and bearing 16. Thus, projection 20 could be fixedly secured to the inner surface of the sphere 12 and extend into a hole in the leg 24.

The present invention may be embodied in other specific forms without departing from the spirit or essential attributes thereof and, accordingly, reference should be made to the appeded claims, rather than to the foregoing specification as indicating the scope of the invention.

We claim:

1. A toy comprising a rigid, hollow transparent ball, a figure within said ball, means movably supporting said figure within said ball, said means including a first gear fixed to the inner periphery of said ball, a second gear fixed to said figure, said gears being in mesh so that rotation of said ball rotates said first gear relative to said second gear and drives said figure, said figure being supported for rotation and a limited amount of tilting at a location on the inner periphery of said ball and generally diametrically opposite said first gear, said tilting being sufficient to change the meshed portions of the gears without relative rotation thereof.

2. A toy in accordance with claim 1 wherein one of said gears is annular with teeth on its inner periphery, the other of said gears having teeth on its outer periphery.

3. A toy in accordance with claim 1 wherein said figure has at least one arm and at least one leg which extend in generally opposite directions, said second gear being fixed to said arm, and said leg being supported for rotation and limited pivotably movement on the inner peripheral surface of said sphere generally diametrically opposite said first gear.

4. A toy in accordance with claim 1 wherein said ball is made of a polymeric plastic, said gears being made from a transparent polymeric plastic, and said figure being a molded plastic figure having a center of gravity eccentrically located.

5. A toy comprising a rigid, hollow transparent ball, a figure within said ball, means movably supporting said figure within said ball, said means including a first gear fixed to the inner periphery of said ball, a second gear fixed to said figure, said gears being in mesh so that rotation of said ball rotates said first gear relative to said second gear and drives said figure, said first gear being an annular gear with teeth on its inner periphery, said second gear having teeth on its outer periphery, the pitch diameter of said first gear being sufficiently greater than the pitch diameter of said second gear to allow said second gear to rotate within said first gear and relative thereto.

6. A toy comprising a rigid, hollow transparent ball, a figure within said ball, a first gear fixed to the inner periphery of said ball, said first gear being an annular gear having teeth on its inner periphery, a second gear meshed with said first gear and rotatable relative thereto, said second gear being within said first gear and being fixedly secured to said figure, means defining a bearing for said figure within said sphere, said bearing being generally diametrically opposite said first gear.

7. A toy in accordance with claim 6 wherein said figure has a first limb fixedly connected to said second gear and a second limb rotatably guided by said bearing, said limbs extending in generally opposite directions.

8. A toy in accordance with claim 6 wherein said gears are transparent with the pitch diameter of said first gear being approximately twice the pitch diameter of the second gear, said bearing being of sufficient size to allow said figure to tilt to a limited extent defined by the pitch diameter of said first gear.

* * * * *